United States Patent [19]

Dompas

[11] 3,981,351

[45] Sept. 21, 1976

[54] MOLD FOR THE CONTINUOUS VERTICAL CASTING OF BILLETS

[75] Inventor: John Dompas, Olen, Belgium

[73] Assignee: Metallurgie Hoboken-Overpelt, Brussels, Belgium

[22] Filed: Nov. 13, 1974

[21] Appl. No.: 523,405

[30] Foreign Application Priority Data

Nov. 26, 1973 Luxemburg ..... 68861

[52] U.S. Cl. ..... 164/283 R; 164/348

[51] Int. Cl.[2] ..... B22D 11/124

[58] Field of Search ..... 249/79, 81; 164/283 S, 164/283 M, 82, 89, 283, 384

[56] References Cited

UNITED STATES PATENTS

| | | | |
|---|---|---|---|
| 901,133 | 10/1908 | Wayman | 249/79 |
| 2,767,448 | 10/1956 | Harter | 164/283 |
| 2,772,459 | 12/1956 | Wieland | 164/89 |
| 3,463,220 | 8/1969 | Moritz | 164/89 X |
| 3,464,485 | 9/1969 | Landgraf | 164/283 M |
| 3,512,574 | 5/1970 | Taylor | 164/89 |
| 3,572,420 | 3/1971 | Summers | 164/82 |
| 3,662,814 | 5/1972 | Kipp | 164/283 M |
| 3,710,840 | 1/1973 | Fabens | 164/89 |
| 3,749,152 | 7/1973 | Dore | 164/283 R |
| 3,763,920 | 10/1973 | Auman | 164/283 M |

*Primary Examiner*—Francis S. Husar
*Assistant Examiner*—John S. Brown
*Attorney, Agent, or Firm*—Fred Philpitt

[57] ABSTRACT

A mold with a cooling jacket for the continuous vertical casting of metal billets, comprising between the lower part of the mold and the jacket a tubular wall the upper part of which is surrounded by ribs forming with the external side of the wall and with the internal side of the jacket a plurality of channels, said tubular wall forcing the cooling liquid introduced laterally into the jacket first to rise, then to divide itself regularly between the said ribs and to form simultaneously a laminar flow, then to flow down in that state along the mold and to leave in that state the cooling space through an annular slot.

13 Claims, 2 Drawing Figures

FIG. 1
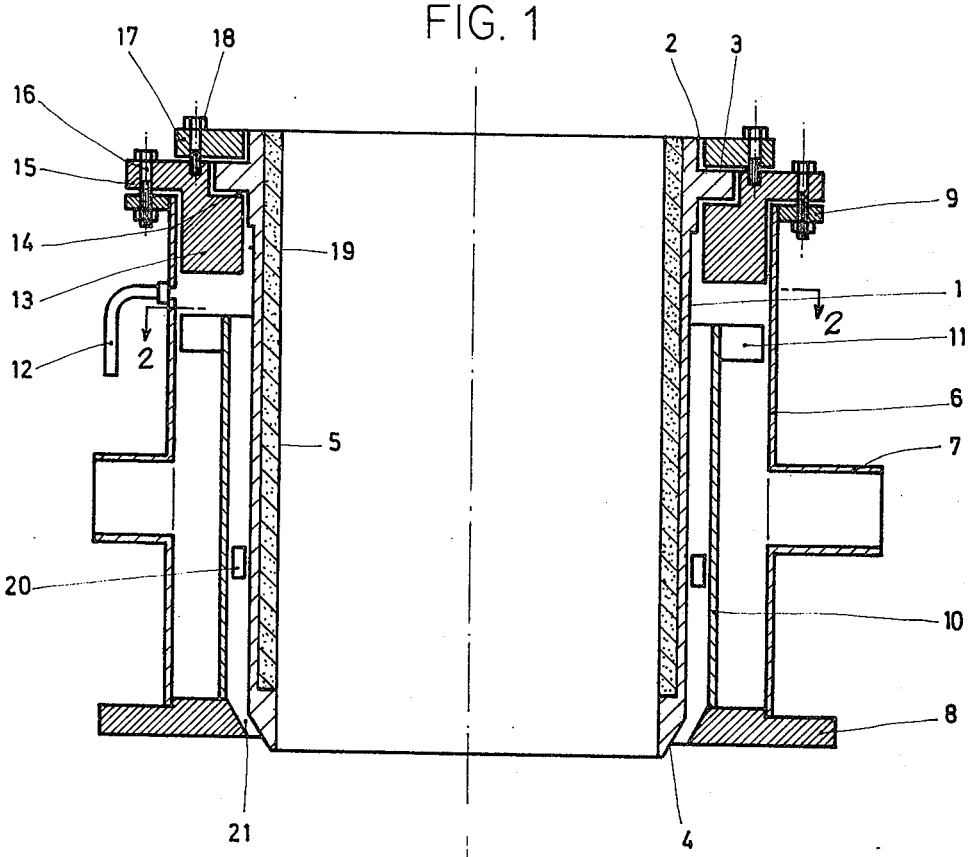
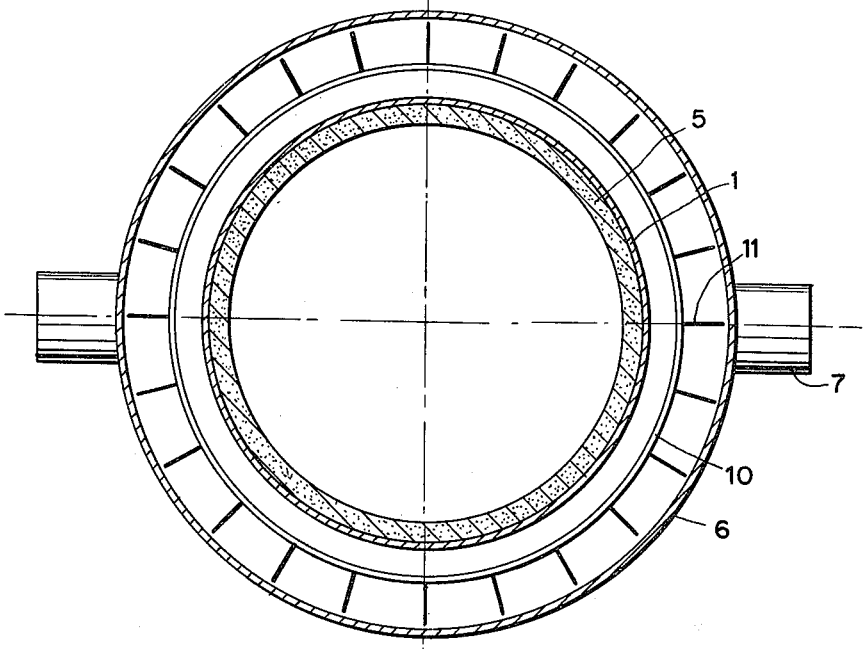
FIG. 2

MOLD FOR THE CONTINUOUS VERTICAL CASTING OF BILLETS

The present invention relates to a mold with cooling jacket for the continuous vertical casting of billets, more particularly of copper, of the type in which the cooling jacket is provided laterally with means for introducing a cooling fluid into the space comprised between the mold and the jacket, said space ending downwards in an annular slot inclined towards the exit of the mold and intended to serve as a slot for the evacuation of the said cooling fluid in the direction of the billet leaving the mold.

A mold of the above type is known already for the casting of copper, in which the cooling fluid is injected tangentially into the upper part of the jacket. Such a mold has the drawback that the cooling fluid descends along the mold in a strongly turbulent flow and leaves in that state the cooling space the annular slot, so that the cooling fluid is not uniformly distributed either around the mold, or around the billet leaving the mold.

Cooling jackets for continuous casting molds have also been proposed which allow the cooling fluid to travel through a complicated labyrinth formed by several baffles. before coming into contact with the mold in order to obtain a laminar flow. Besides their complicated construction, these jackets of the prior art have the drawback of producing a considerable loss of pressure of the cooling liquid.

The mold according to the invention avoids the drawbacks of the known devices.

The invention relates to a mold with cooling jacket for the continuous vertical casting of billets, more particularly of copper, of the type mentioned above, said mold being characterized by the presence, between the lower parts of the mold and the jacket, of a tubular wall of which the upper part is surrounded by ribs forming with the external side of the wall and the internal side of the jacket a plurality of channels, said wall forcing the current of cooling liquid introduced laterally into the jacket first to rise, then to divide itself regularly between said ribs and to form simultaneously a laminar flow, to flow down in that state along the mold and to leave the cooling space in that state through the annular slot.

It is preferred that the ribs shall be spaced uniformly around the wall, that their number shall exceed 17 and that their height shall be comprised between 10 and 60 mm.

The means for admitting the cooling liquid into the jacket will advantageously be formed by two horizontal pipes disposed radially relatively to the mold and diametrically opposed.

The cross-section of the tubular space between the wall and the mold will preferably be equal to, or lower than the total cross-section of the means for the admission of the cooling fluid in such a manner as to ensure inside said tubular space a flow of cooling fluid such as to prevent the formation of a vapour film.

The cross-section of the annular slot for the evacuation of the cooling fluid will advantageously be lower than 0.9 times the total cross-section of the means for the introduction of the cooling fluid so as to ensure continuously a complete filling of the jacket. The angle between the slot and the axis of the mold will preferably be lower than 25° in order to avoid on the one hand a push of the cooling fluid upwards and on the other hand a rebounding of said fluid, which would lower the cooling capacity of the fluid jet leaving the slot.

The height of the slot will advantageously be more than 10 mm to ensure that the issuing fluid jet shall be quite flat.

For the mold of the invention it is also advantageous to foresee in the upper part of the cooling space between the mold and the jacket, a metal ring preventing the cooling liquid from reaching the said part in order to moderate the rate of solidification at the top of the mold. The height of this metal ring may be comprised between 20 and 100 mm. Between said ring and the mold an annular slot may be provided, in which a thin insulating layer of vapour coming from the cooling fluid may be formed.

Above the level of the tubular wall, the jacket may be provided with a small overflow tube acting as a witness of the level or of the pressure of the cooling fluid.

The following description of one mode of carrying into effect the mold of the invention, given by way of a non-restricting example, and illustrated in the accompanying drawing will allow of better understanding the invention.

FIG. 1 shows an axial section of a mold according to the invention intended for the continuous (or semi-continuous) casting of copper billets.

FIG. 2 is a view along 2—2 of FIG. 1.

In the drawing, the numeral 1 shows a tubular copper mold, the head of which has on its outside a small shoulder 2, itself provided with a collar 3, and the lower edge of which is bevelled on its outside at an angle of 20°, and which is provided inside with a shoulder 4, supporting a graphite liner 5.

The mold 1 is surrounded by a cooling jacket 6 made of steel, provided laterally with two horizontal pipes 7 for introducing the cooling fluid. These pipes 17 are disposed radially to the jacket 6 and to the mold 1 and are diametrically opposed.

The cooling jacket 6 is secured to a bottom flange 8 and to an upper flange 9. Upon the interior edge of the flange 8, which is bevelled at an angle of 20°, a tubular steel wall 10 is secured, the head of which is surrounded for instance by 24 steel ribs 11 of 20 mm height, forming with the internal side of jacket 6 and the external side of the wall 10 24 equal vertical channels. Above the level of the wall 10, the cooling jacket 6 is provided with a small overflow tube 12.

A 50 mm high steel ring 13, provided at its upper part with a recess 14 to receive the collar 3 of the mold 1 and with a collar 15, is secured inside the head of the cooling jacket by means of the upper flange 9 and of the bolts 16.

The mold 1 is itself secured to the recess 14 of the ring 13 by means of a tightening flange 17 and screws 18. Thanks to the presence of the shoulder 2, an annular slot 19 of 2 mm thickness remains between the mold 1 and the ring 13.

The centering of the mold 1 inside its cooling jacket is ensured by three centering pieces 20 secured to the interior side of the wall 10. Between the space the bevelled lower edges of the mold 1 and the bottom flange 8 an annular slot 21 remains, with an inclination of 20° relatively to the axis of the mold 1.

What I claim is:

1. A device for the continuous vertical casting of metal billets which includes a. a tubular mold having an upstream end and a downstream end, b. a cooling jacket disposed annularly with respect to said tubular mold, c. fluid inlet means for introducing a cooling fluid into the space between said tubular mold and said cooling jacket, d. an annular fluid discharge slot located adjacent the downstream ends of said tubular mold and said cooling jacket, e. a tubular member disposed between the exterior of said tubular mold and the interior of said cooling jacket and extending upwardly an axial distance less than said mold and said cooling jacket, f. a plurality of rib members extending outwardly from the upper part of said tubular member toward the inner wall of said cooling jacket so as to thereby form a plurality of flow channels, and g. a passageway extending from said fluid inlet means, past said rib members, around the end of said tubular member and then to said annular fluid discharge slot, whereby when fluid is introduced into said fluid inlet means it will flow in the space between the inner wall of said cooling jacket and the outer wall of said tubular member toward the upstream end of said tubular mold, be divided into a plurality of flow streams by said rib members, and then flow in a laminar streams between the inner wall of said tubular member and the outer wall of said tubular mold toward said annular fluid discharge slot.

2. A device according to claim 1 in which the number of ribs is higher than 17.

3. A device according to claim 1 in which the height of the ribs is between 10 and 60 mm.

4. A device according to claim 1 in which the ribs are spaced uniformly around said tubular member.

5. A device according to claim 1 in which the fluid inlet means consists of two horizontal pipes arranged radially relatively to the mold and diametrically opposed.

6. A device according to claim 1 in which a tubular space is provided between said tubular member and the tubular mold, the cross section of which is equal to, or less than the total cross-section of the means through which the cooling liquid is introduced, to ensure inside the said tubular space a flow of cooling fluid preventing the formation of a film of vapour.

7. A device according to claim 1 in which the cross section of said discharge slot is less than 0.9 times the total cross-section of said fluid inlet means.

8. A device according to claim 1 in which the angle formed by the annular slot and by the axis of the tubular mold is less than 25°.

9. A device according to claim 1 in which the height of said discharge slot is greater than 10 mm.

10. A device according to claim 1 which includes a metal ring at the upper part of the space between the tubular mold and the cooling jacket, said metal ring being spaced upwardly from said tubular member and preventing any cooling liquid from reaching the upstream extremity of said tubular mold.

11. A device according to claim 10 in which the height of the metal ring is comprised between 20 and 100 mm.

12. A device according to claim 11 comprising between said tubular mold and said metal ring an annular slot inside which a thin insulating layer of vapour coming from the cooling fluid is formed.

13. A device according to claim 1 characterized in that the cooling jacket is provided, above the level of the tubular member, with a small overflow tube indicating the level or pressure of the cooling fluid.

* * * * *